US007726646B2

(12) United States Patent
Sugiyama et al.

(10) Patent No.: US 7,726,646 B2
(45) Date of Patent: Jun. 1, 2010

(54) SHEET PACKAGE WITH RECLOSEABLE FLAP

(75) Inventors: Koji Sugiyama, Nagoya (JP); Hiroshi Taira, Ichinomiya (JP); Minoru Yamamoto, Nagoya (JP); Keiji Seo, Nagoya (JP); Takashi Okumura, Nagoya (JP); Katsuhiko Shimada, Nagoya (JP); Mutsuo Naoe, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 460 days.

(21) Appl. No.: 10/509,382

(22) PCT Filed: Mar. 17, 2003

(86) PCT No.: PCT/JP03/03203

§ 371 (c)(1),
(2), (4) Date: May 31, 2005

(87) PCT Pub. No.: WO03/082716

PCT Pub. Date: Oct. 9, 2003

(65) Prior Publication Data

US 2005/0230902 A1 Oct. 20, 2005

(30) Foreign Application Priority Data

Mar. 28, 2002 (JP) ..... 2002-092826

(51) Int. Cl.
*B65H 1/00* (2006.01)

(52) U.S. Cl. ..... 271/145; 271/126; 271/162; 206/455; 206/449; 221/186; 221/198

(58) Field of Classification Search ..... 271/145, 271/126, 228, 162, 164; 221/197, 287, 43, 221/46, 49, 62, 186, 198, 305; 206/494, 206/449, 455
See application file for complete search history.

(56) References Cited

U.S. PATENT DOCUMENTS

| | | | | | |
|---|---|---|---|---|---|
| 1,883,852 | A | * | 10/1932 | Medoff | 206/449 |
| 4,192,420 | A | * | 3/1980 | Worrell et al. | 206/205 |
| 4,964,511 | A | * | 10/1990 | Meschi | 206/449 |
| 5,572,310 | A | * | 11/1996 | Hoberock et al. | 399/370 |
| 5,678,691 | A | * | 10/1997 | Amado-Aguilar et al. | 206/451 |
| 5,833,059 | A | * | 11/1998 | Werner et al. | 206/232 |
| 5,836,449 | A | * | 11/1998 | Peeters | 206/455 |
| 5,988,372 | A | * | 11/1999 | Kawagoe et al. | 206/232 |

(Continued)

FOREIGN PATENT DOCUMENTS

| | | | |
|---|---|---|---|
| JP | 48-104334 | * | 12/1973 |

(Continued)

*Primary Examiner*—Patrick Mackey
*Assistant Examiner*—Gerald W McClain
(74) *Attorney, Agent, or Firm*—Oliff & Berrige, PLC

(57) ABSTRACT

A sheet in accordance with the present invention includes sheets as print mediums for a printer and a package member surrounding the sheets which have been stacked up. The sheet package is configured so that the sheets can be set in the printer together with the package member exposing part of the sheets. The package member is integrally provided with a flap part which can expose part of the sheets by being opened when the sheet package is set in the printer and cover the exposed part of the sheets by being closed when the sheet package is not used.

17 Claims, 18 Drawing Sheets

PROCESS FOR SETTING PACKAGE IN PRINTER: 2

U.S. PATENT DOCUMENTS

| | | | | |
|---|---|---|---|---|
| 6,029,425 | A * | 2/2000 | Dunn | 53/449 |
| 6,217,019 | B1 * | 4/2001 | Ishiduka et al. | 271/147 |
| 6,546,210 | B1 * | 4/2003 | Nakamura | 399/12 |
| 6,598,795 | B1 * | 7/2003 | Prenn | 235/462.01 |
| 6,669,363 | B2 * | 12/2003 | Nakajo | 378/182 |
| 7,159,717 | B2 * | 1/2007 | Aldridge et al. | 206/449 |
| 2003/0164317 | A1 * | 9/2003 | Fujiwara | 206/425 |
| 2004/0089671 | A1 * | 5/2004 | Miller | 221/305 |
| 2005/0258062 | A1 * | 11/2005 | Bando | 206/494 |

FOREIGN PATENT DOCUMENTS

| | | | |
|---|---|---|---|
| JP | 04317929 | A * | 11/1992 |
| JP | A 4-317929 | | 11/1992 |
| JP | A-2000-203725 | | 7/2000 |
| WO | WO 99/47362 | A1 | 9/1999 |

* cited by examiner

MANUFACTURING PROCESS
OF SHEET PACKAGE: 1

MANUFACTURING PROCESS
OF SHEET PACKAGE: 2

MANUFACTURING PROCESS
OF SHEET PACKAGE: 3

MANUFACTURING PROCESS
OF SHEET PACKAGE: 4

MANUFACTURING PROCESS OF SHEET PACKAGE: 5

PROCESS FOR SETTING PACKAGE IN PRINTER: 1

PROCESS FOR SETTING PACKAGE IN PRINTER: 2

PROCESS FOR SETTING PACKAGE IN PRINTER: 3

PROCESS FOR SETTING PACKAGE IN PRINTER: 4

PROCESS FOR SETTING PACKAGE IN PRINTER: 5

PROCESS AFTER USING SHEETS:1

PROCESS AFTER USING SHEETS:2

SHEET PACKAGE WITH RECLOSEABLE FLAP

TECHNICAL FIELD

The present invention relates to a configuration of a sheet package holding a stack of sheets for a printer and in particular, to the configuration of a sheet package which can protect the exterior of a stack of sheets by a package member and which can be set in a printer together with the package member.

BACKGROUND OF THE INVENTION

As a known configuration of a sheet package, numbers of sheets which have been stacked up are surrounded and covered with a package member, and the package member is opened when the sheets are used for a printer. Such configuration allows a user to handle numbers of sheets in a mass, package by package, and thereby provides improved usability of sheets. The configuration, covering and protecting the sheets inside, is especially advantageous when heat-sensitive sheets susceptible to light and heat are employed as the print sheets.

The sheet package is opened by cutting off a flap part of the package member to expose part of the sheets and then set in a printer together with the package member for use in the printer.

DISCLOSURE OF THE INVENTION

However, when a conventional sheet package is used for a printer by cutting of f the flap part and thereafter the sheet package before using up all the sheets inside is removed from the printer for setting sheets of a different type in the printer, the package member of the removed sheet package can not be closed again.

Therefore, the sheets inside the removed sheet package easily come out of the package member due to gravity, etc., toughening the handling of the removed sheet package. Especially when the print surface of the sheet is specified, the printing by use of the sheet package becomes impossible unless the sheets fallen out of the package member are correctly returned to the package member in the same direction.

It is therefore the primary object of the present invention to prevent sheets inside a sheet package from easily coming out of a package member even after the sheet package is once used for a printer.

In accordance with an aspect of the present invention, there is provided a sheet package including sheets as print mediums for a printer and a package member surrounding the sheets which have been stacked up, which is configured so that the sheets can be set in the printer together with the package member exposing part of the sheets. In the sheet package, the package member is integrally provided with a flap part which is capable of exposing part of the sheets by being opened when the sheet package is set in the printer and is also capable of covering the exposed part of the sheets by being closed when the sheet package is not used.

With this configuration, the flap part can be closed even after the sheet package with the flap part opened is set in a printer and thereafter the sheet package is removed from the printers by which the sheets inside the sheet package can be prevented from coming out of the package member due to gravity, etc. and being scattered around.

Further, since the flap part is formed integrally with the package member, the user is prevented from losing the flap part and being unable to close the package member.

In accordance with another aspect of the present invention, there is provided a sheet package including sheets as print mediums for a printer and a package member surrounding the sheets which have been stacked up, which is configured so that the sheets can be set in the printer together with the package member exposing part of the sheets. In the sheet package, the package member includes a base having a rectangular shape and substantially the same size as the sheet. Around the base, a flap part, a tongue part opposed to the flap part a first wrapping part, and a second wrapping part opposed to the first wrapping part are formed. The package member is configured so that the package member can be fixed in a box shape by folding the flap part, the first wrapping part, the second wrapping part and the tongue part with respect to the base. The flap part is configured so that the flap part can be turned from a closed state covering the sheets to an opened state exposing part of the sheets by folding the flap part to the base side. The sheet package is configured so that the sheet package can be set in the printer with the flap part fixed in the opened state exposing the part of the sheets while the sheet package can cover the exposed part of the sheets with the flap part fixed in the closed state when the sheet package is not used.

With this configuration, the flap part can be closed even after the sheet package with the flap part opened is set in a printer and thereafter the sheet package is removed from the printer, by which the sheets inside the sheet package can be prevented from coming out of the package member due to gravity, etc. and being scattered around.

Further, since the flap part is formed integrally with the package member, the user is prevented from losing the flap part and being unable to close the package member.

In accordance with another aspect of the present invention, there is provided a sheet package including sheets as print mediums for a printer and a package member surrounding the sheets which have been stacked up and having an indicator part indicating information on the sheets. The sheet package is configured so that the sheets can be set in the printer together with the package member exposing part of the sheets and the indicator part can be seen through a window of the printer when the sheet package is set in the printer. The package member is formed by folding a plane material which is designed so that a joining part of the material will not be placed at a position corresponding to the window of the printer.

With this configuration, the indicator part, which is formed at the position corresponding to the window of the printer by printing, etc., is not needed to be formed across the joining part, by which the indicator part can be printed easily. Further, the indicator part is prevented from being irregular or unrecognizable since misregistration at the joining part in the formation of the indicator part is avoided.

BEST MODE FOR CARRYING OUT THE INVENTION

Figure 1:
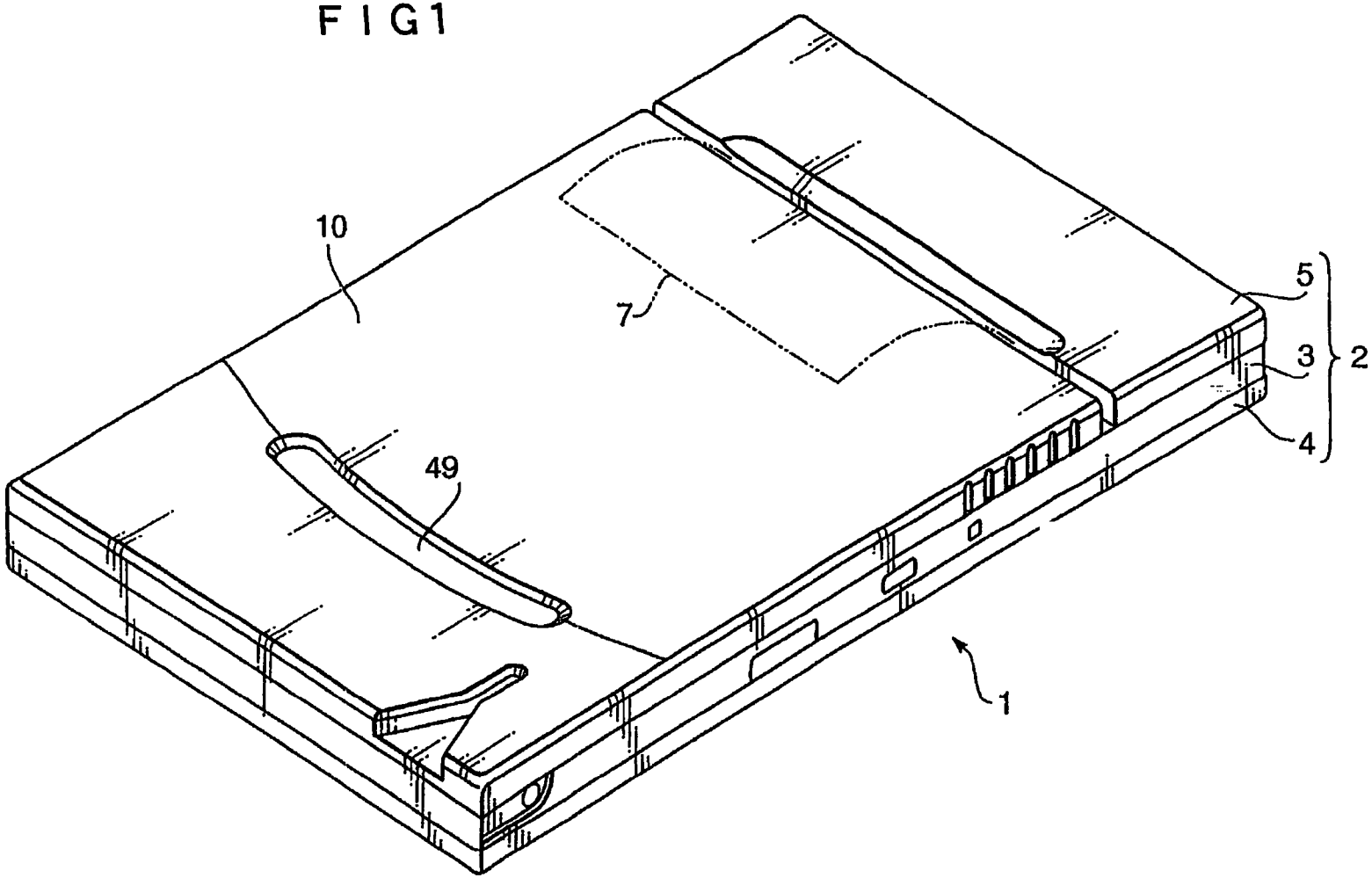
FIG. 1 is a perspective view showing the overall configuration of a printer employed in an embodiment of the present invention.

Referring now to the drawings, a description will be given in detail of preferred embodiments in accordance with the present invention.

[Configuration of Printer]

First, the overall composition of a printer 1 will be described referring to FIGS. 1 through 4.

Figure 2:
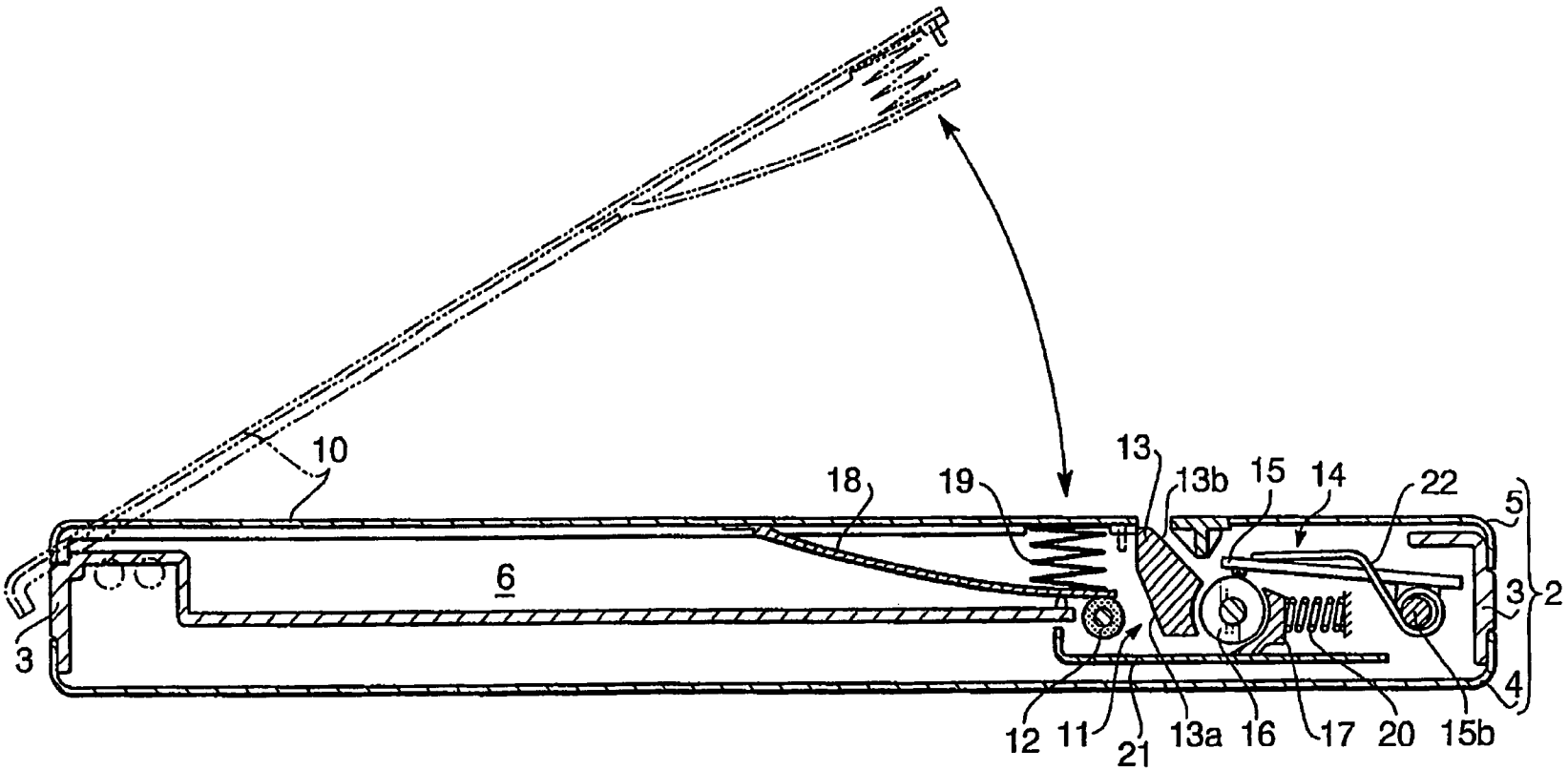
FIG. 2 is a sectional side view of the printer of FIG. 1.
Figure 3:
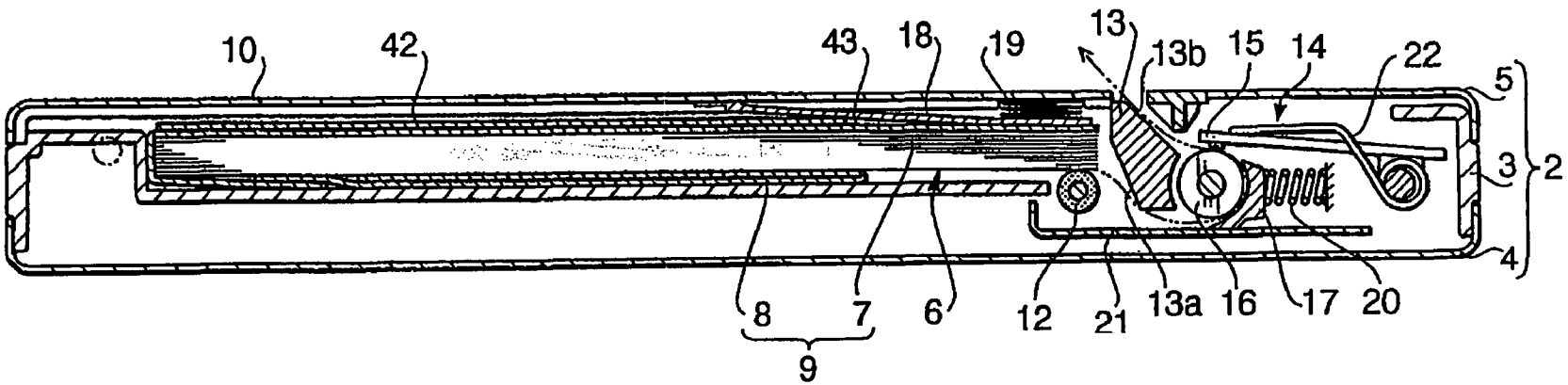
FIG. 3 is a sectional side view showing a state in which print sheets are set in a sheet storage unit of the printer.
Figure 4:
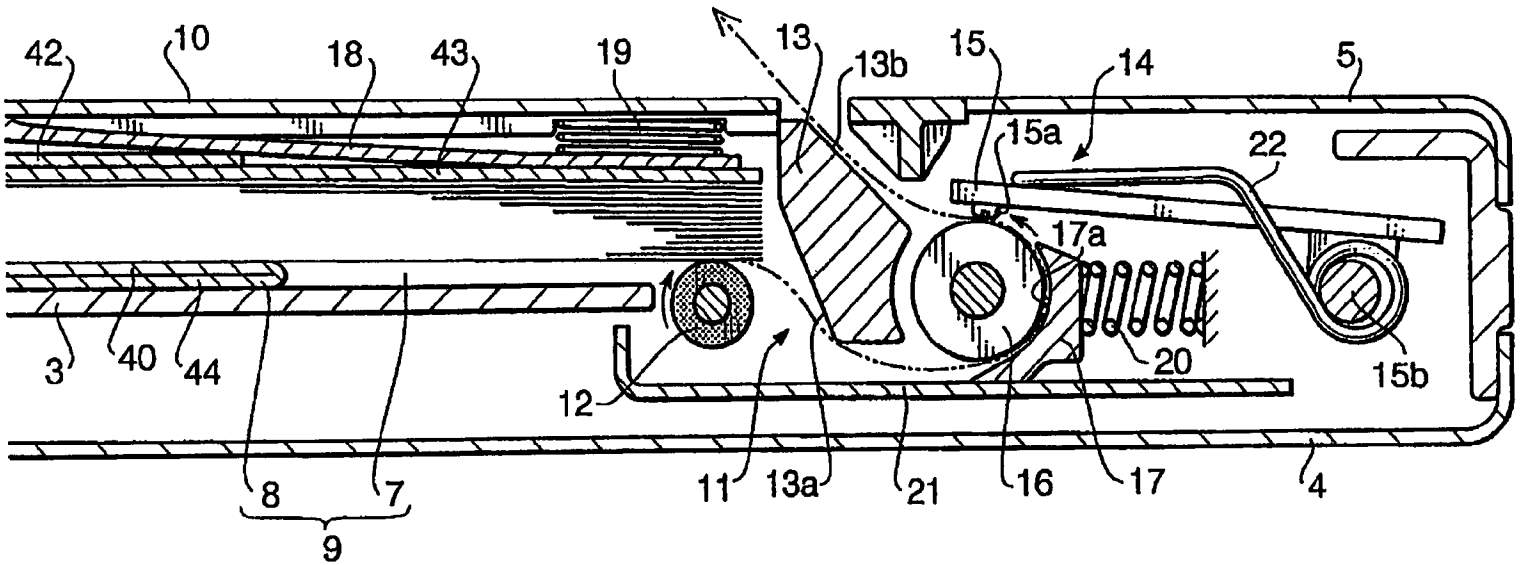
FIG. 4 is an enlarged sectional view showing the details of a sheet separation unit and a print mechanism unit.

FIG. 1 is a perspective view of the printer 1. FIG. 2 is a sectional side view of the printer 1. FIG. 3 is a sectional side view showing a state in which print sheets are set in a sheet storage unit. FIG. 4 is an enlarged sectional view showing the details of a sheet separation unit and a print mechanism unit.

As shown in FIG. 1, the printer 1 is formed compact in size, with a rectangular shape of approximately A6 size or A7 Size in a plan view and a thickness of approximately 2 cm or less.

The printer 1 has a body case 2. The body case 2 includes a frame 3, a lower cover 4 covering the bottom of the frame 3, and an upper cover 5 covering part of the top of the frame 3.

In a part of the upper part of the frame 3 that is not covered with the upper cover 5, a sheet storage unit (sheet supply unit) 6 is formed as shown in FIG. 3. In the sheet storage unit 6, a sheet package 9 is inserted and set.

The sheet package 9 is a package formed by storing a plurality of heat-sensitive cut sheets 7 of A6-A7 size (record mediums, hereinafter referred to as "sheets 7") in a package member 8.

The top of the sheet storage unit 6 is covered with a lid 10, which is rotatable with respect to the body case 2 as shown in FIG. 2. The body case 2 is provided with an unshown lock mechanism, by which the lid 10 can be locked at a closed position as shown in FIG. 3 with the sheet package 9 loaded in the sheet storage unit 6 as described above.

At one end of the sheet storage unit 6, a sheet separation unit 11 including a pickup roller 12, a separation block 13, etc. is placed. Beneath the upper cover 5, a print mechanism unit 14 (described in detail later) including a thermal head 15, a platen roller 16 and a paper guide 17 is placed.

The sheet separation unit 11 will be explained below.

As shown in FIG. 4, to one end of the sheet storage unit 6 in the vicinity of the print mechanism unit 14, the pickup roller 12 and the separation block 13 are provided. On the inner surface of the lid 10 facing the sheet storage unit 6, a pressure plate 18 is supported rotatably.

A coil spring 19 is placed between the pressure plate 18 and the lid 10 so as to constantly exert pressure on the pressure plate 18 to rotate it downward.

The sheet package 9 is set in the sheet storage unit 6, with the lower surface of the lowermost one of the stacked sheets 7 (stacked up and stored in the package member 8 with their print surfaces facing downward) being exposed partially from the package member 8. When the lid 10 is closed and locked, the pressure plate 18 (pressed downward by the aforementioned spring 19) presses the exposed part of the sheet 7 against the pickup roller 12 via the package member 8, letting the lower surface of the sheet 7 contact the pickup roller 12.

The separation block 13, provided in the vicinity of the pickup roller 12, has a separation guide surface 13*a* being tilted with respect to the sheet feed direction of the pickup roller 12.

In this configuration, the pickup roller 12 which is driven and rotated exerts feeding force on the lowermost sheet 7 contacting the pickup roller 12. As a principle, the lowermost sheet 7 is conveyed by the feeding force of the pickup roller 12 (caused by the spring 19) exceeding braking force from the separation guide surface 13*a* and negative frictional force from a (second) sheet on the conveyed sheet. The second lowermost sheet on the conveyed sheet receives positive frictional force from the lowermost sheet, negative frictional force from a third lowermost sheet and braking force from the separation guide surface 13*a* and thereby stays at its position with the force balance, by which multifeeding is avoided. With the separating function of the separation guide surface 13*a* of the separation block 13, only one sheet 7 at the bottom of the stacked sheets is separated and conveyed out of the sheet package 9.

The print mechanism unit 14 will be explained below.

The platen roller 16 is rotatably provided next to the separation block 13 (on the right-hand side of the separation block 13 in FIG. 3), and the paper guide 17 is placed close to the exterior surface of the platen roller 16.

As shown in FIG. 4, the paper guide 17 has a sliding surface 17*a* which is formed to have a concave sectional form like a tilted letter "U" along the exterior surface of the platen roller 16. Between the paper guide 17 and the body case 2, a pressure coil spring 20 is placed so as to press the sliding surface 17*a* against the exterior surface of the platen roller 16.

In this configuration, the sheet 7 separated by the aforementioned sheet separation unit 11 is conveyed by the pickup roller 12 and thereby passes through a gap between the bottom of the separation block 13 and a guide plate 21 for guiding the sheet 7 toward the platen roller 16.

The sheet 7 is guided by the guide plate 21 and fed beneath the platen roller 16 to a gap between the platen roller 16 and the paper guide 17. The sheet 7, held between the exterior surface of the platen roller 16 and the sliding surface 17*a* of the paper guide 17, is conveyed by the revolving platen roller 16 upward being turned over in the tilted U shape and reaches the top of the platen roller 16 with its print surface facing upward.

The thermal head 15, placed nearby the top of the platen roller 16, has a heating element unit 15*a* as a printing unit. The thermal head 15 is provided to be rotatable around a rotation axis 15*b*, by which the heating element unit 15*a* can contact and separate from the top of the platen roller 16.

Incidentally, the thermal head 15 is designed to be rotatable as above so that the thermal head 15 will not disturb a "jammed paper clearance operation" when the sheet 7 has got jammed between the platen roller 16 and the paper guide 17.

To the thermal head 15, an end of a spring 22 of a twisting coil spring type is attached, by which force for pressing the heating element unit 15*a* against the top of the platen roller 16 is applied to the thermal head 15 constantly.

In this configuration, the heating element unit 15*a* of the thermal head 15 makes contact with the upper surface of the sheet (conveyed by the platen roller 16 with its print surface facing upward as above) and the printing on the sheet 7 is carried out at the contacting part.

The thermal head 15, formed as a line head, is capable of printing arbitrary letters, images, etc. on the conveyed heat-sensitive sheet 7, by executing printing on each line orthogonal to the sheet feed direction. The print width on each line is set to a width which is approximately the same as the width of the sheet 7 as the target of printing.

Such a thermal head 15 is employed as the printing head for the following reasons. By use of the heat-sensitive sheets as the record mediums, consumable items like ink, ink ribbons, etc. become unnecessary and mechanisms such as an ink supply mechanism can be left out, by which the printer 1 can be designed compact in size.

As the heat-sensitive sheet, various types of print sheets, such as a heat-coloring sheet having a color layer which takes on a color when heated by the thermal head 15, a heat-perforated sheet which is made by coating a base layer with a perforation layer (perforated by heating), etc. can be employed.

On the aforementioned separation block 13, a sheet ejection guide surface 13*b*, being tilted relative to the sheet feed direction of the platen roller 16, is formed.

In this configuration, the sheet 7 after being printed by the heating element unit 15*a* of the thermal head 15 is guided by the sheet ejection guide surface 13*b* and thereby ejected toward the upside of the lid 10 through a gap between the lid 10 and the upper cover 5 of the body case 2, as shown in FIG. 1.

[Composition of Sheet Package]

Next, the sheet package 9 which is set in the printer 1 in this embodiment will be explained.

Figure 5:
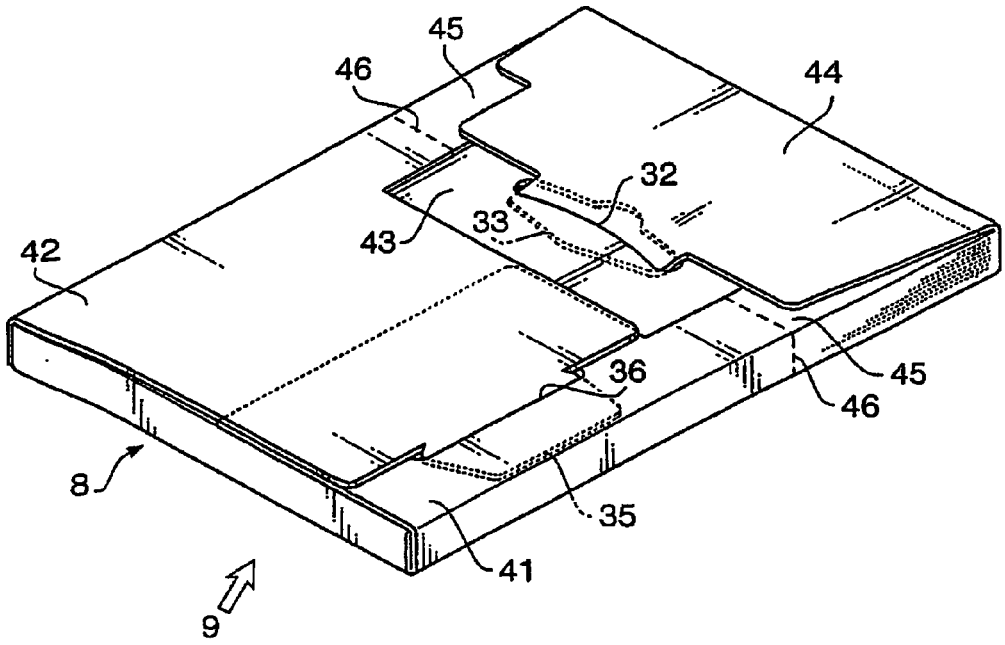
FIG. 5 is a perspective view of a sheet package.
Figure 6:
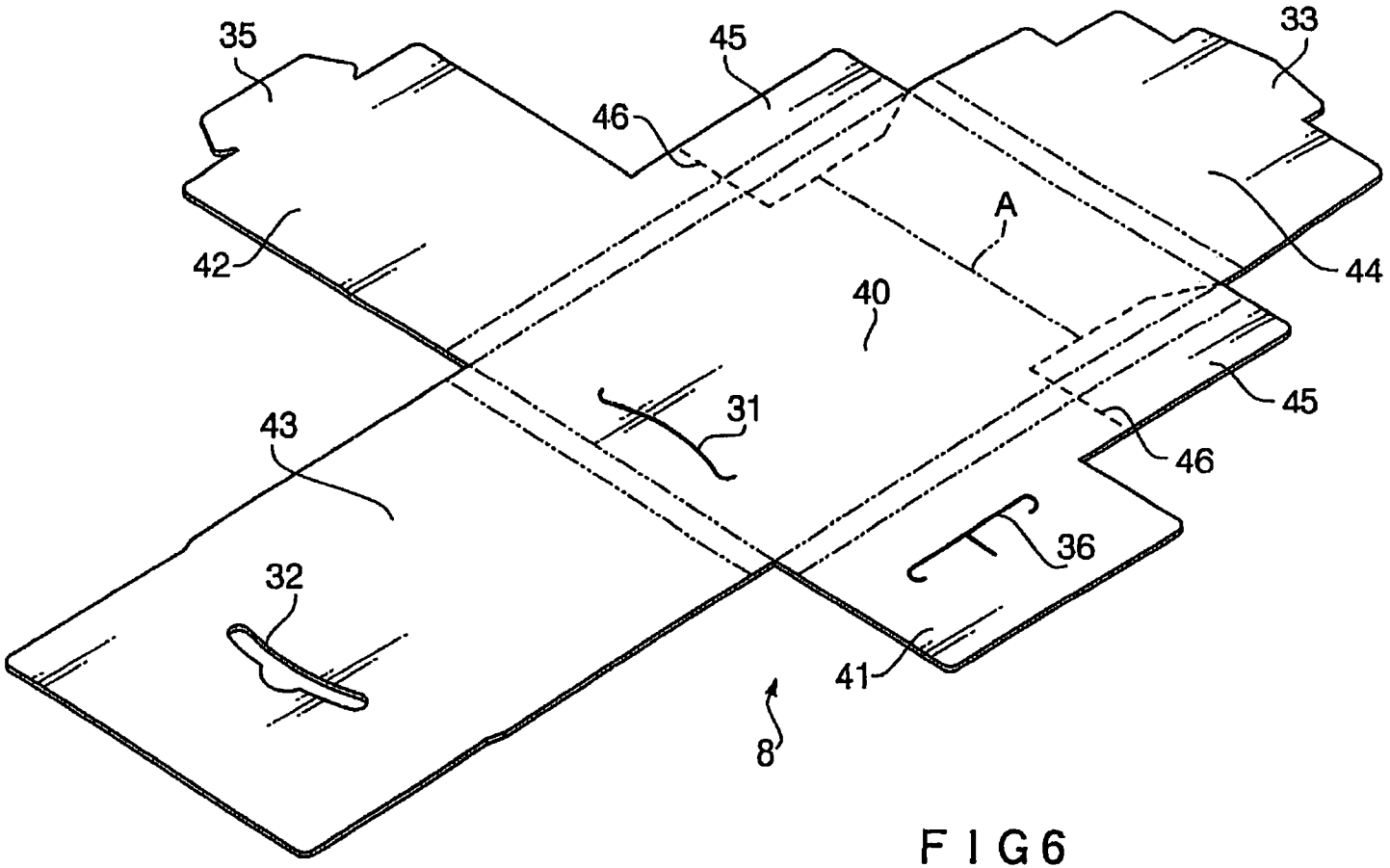
FIG. 6 is a developed view of a package member.

FIG. 5 is a perspective view of the sheet package. FIG. 6 is a developed view of the package member. A process for manufacturing the sheet packages shown in turn in FIGS. 7 through 11.

The sheet package 9 is formed by storing a stack of heat-sensitive paper (small-sized cut sheets of approximately A6-A7 size for example) in the package member 8, as shown in FIG. 5. A user purchases the sheet package 9 in the state shown in FIG. 5, partially exposes the sheets 7 from the package member 8 by a procedure described later, and sets the sheet package 9 in the sheet storage unit 6 of the printer 1.

The package member 8 is formed by folding a plane cardboard material into a box shape. The cardboard material before being folded is shown in FIG. 6. The cardboard material includes a first wrapping part 41, a second wrapping part 42, a tongue part 43 and the flap part 44 which are integrally formed around a base 40 which is in almost the same (rectangular) shape as the sheet 7. Incidentally, thin chain lines in FIG. 6 indicate creased parts, which facilitates the folding of the cardboard material and the assembly of the package member 8.

The base 40, the tongue part 43 and the first wrapping part 41 are provided with a first cut 31, a second cut 32 and a third cut 36, respectively. In each cut, a corresponding part of the package member 8 can be inserted. The details will be explained later.

First, the manufacturing process of the sheet package 9 will be described below.

Figure 7:
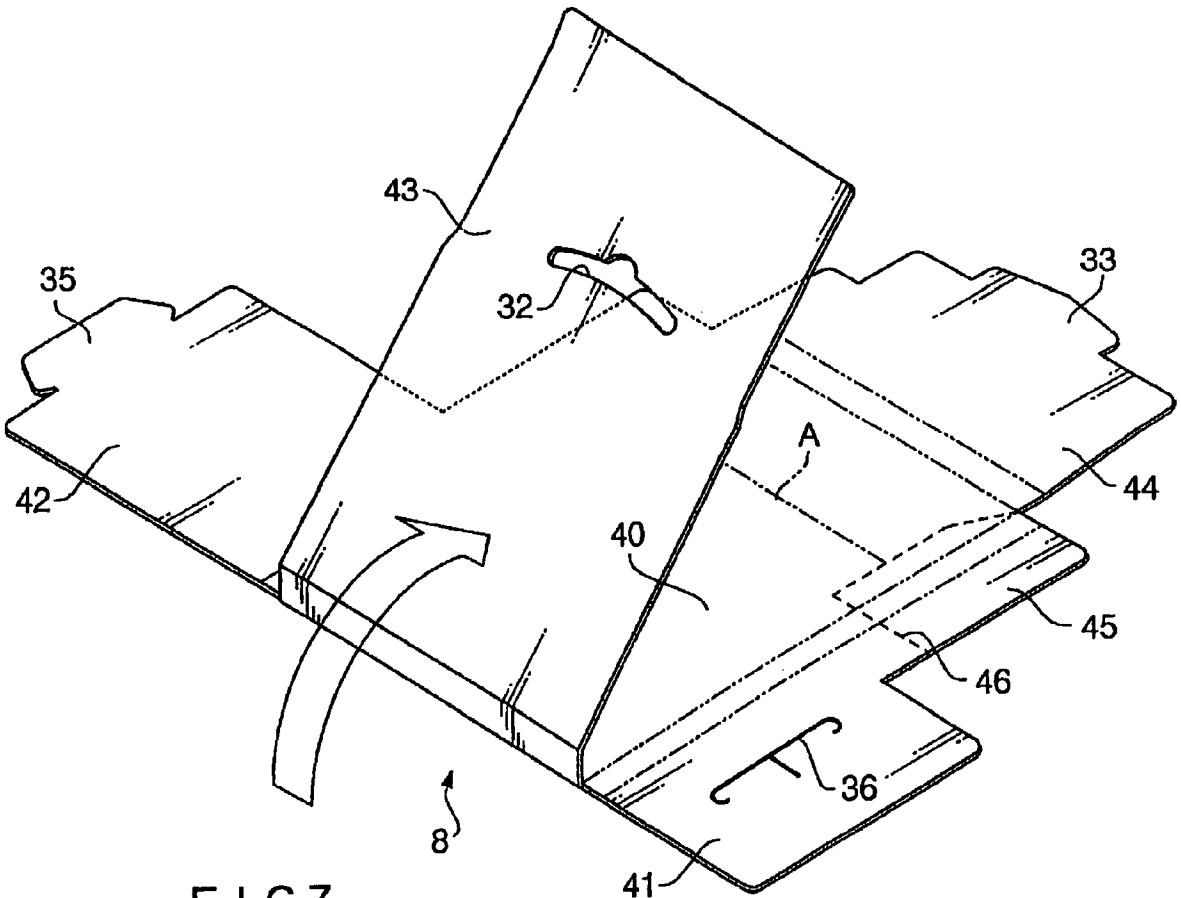
FIG. 7 is a perspective view showing a step for folding a tongue part of the package member.
Figure 8:
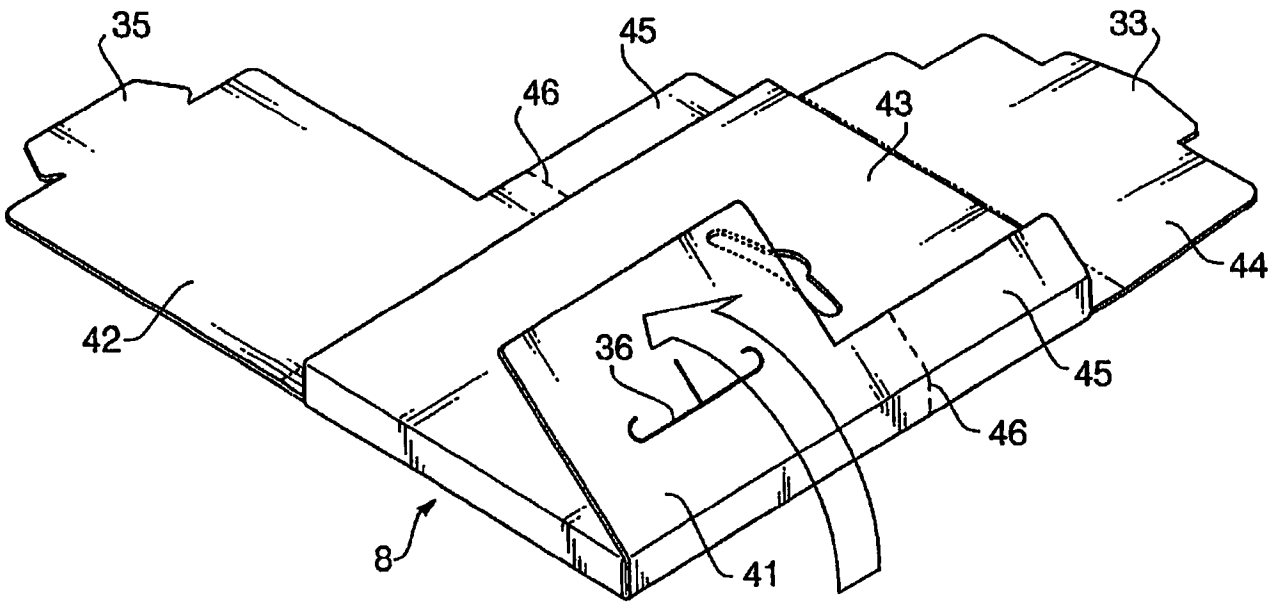
FIG. 8 is a perspective view showing a step for folding a first wrapping part of the package member.
Figure 9:
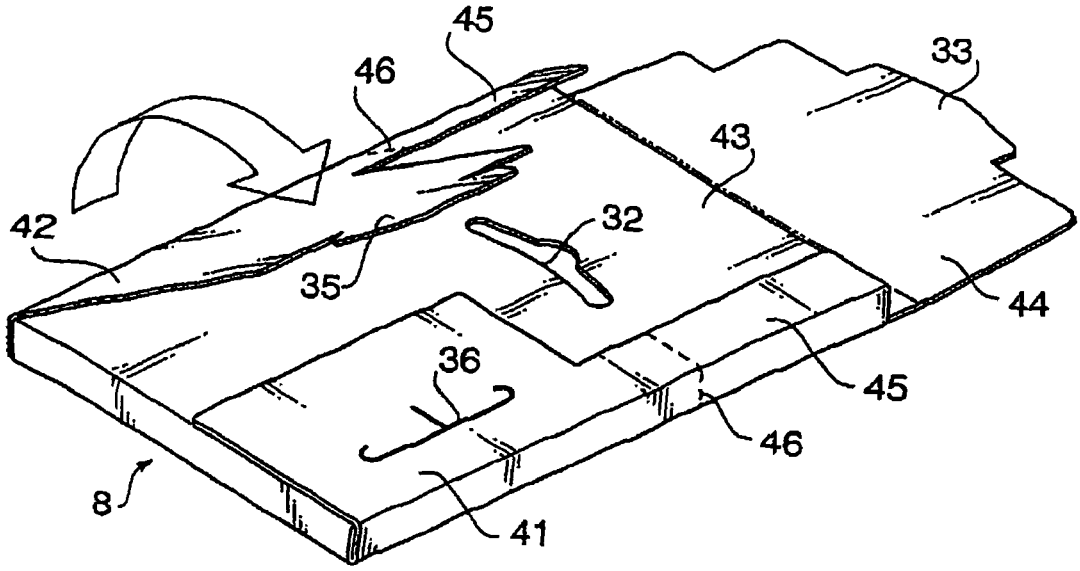
FIG. 9 is a perspective view showing a step for folding a second wrapping part of the package member.
Figure 10:
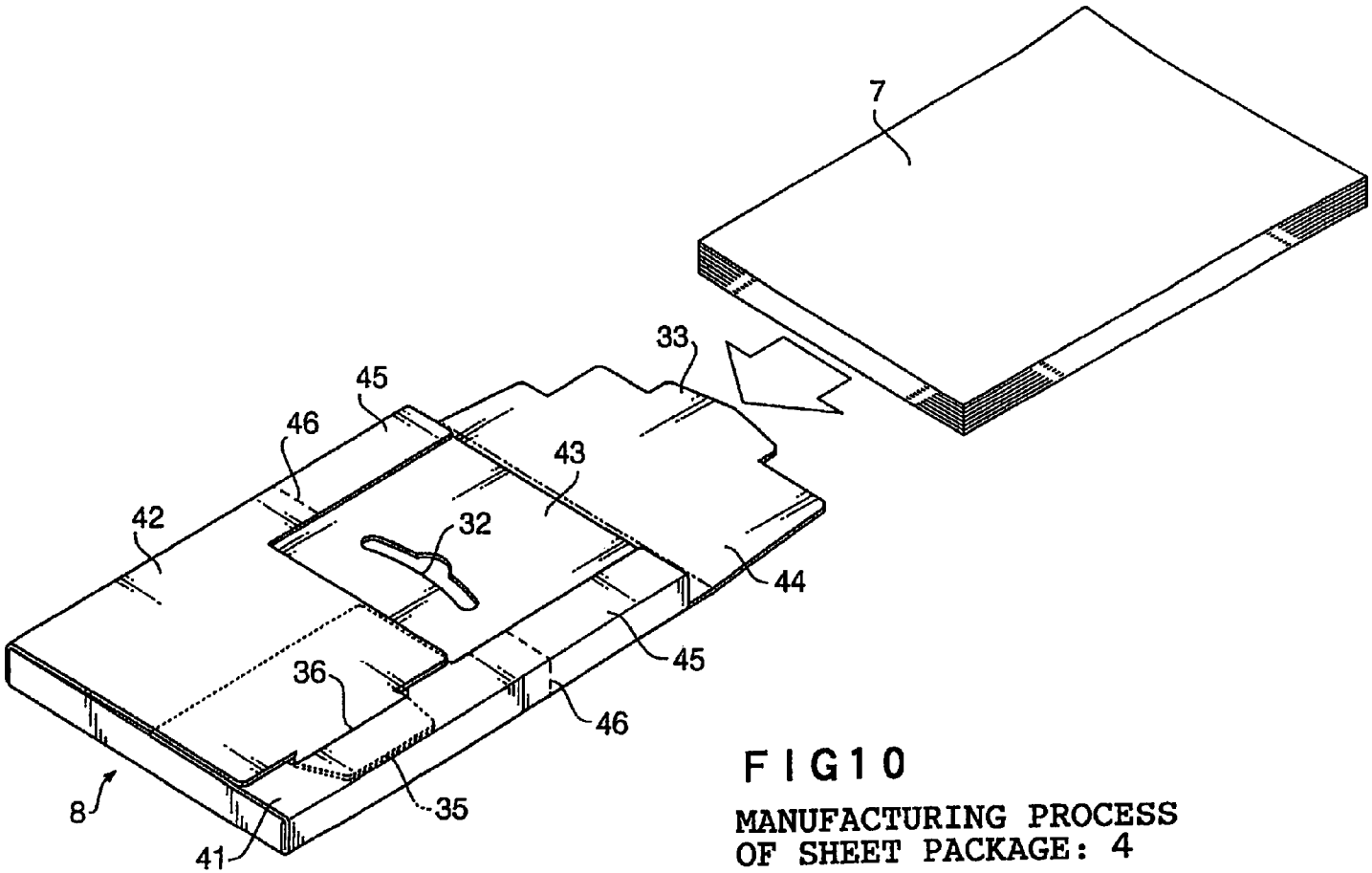
FIG. 10 is a perspective view showing a step for inserting the sheets into the package member.

Starting from the cardboard material in the state of FIG. 6, the tongue part 43 is folded upward as shown in FIG. 7, and the first wrapping part 41 and then the second wrapping part 42 are also folded to be piled up on the folded tongue part 43 (FIG. 8, FIG. 9). Subsequently, an insert 35 formed at the tip of the second wrapping part 42 is inserted into the third cut 36 of the first wrapping part 41, by which a box shown in FIG. 10 is formed. As shown in FIG. 10, the box is formed in a rectangular shape to have an opened end in its lengthwise direction.

Thereafter, the sheets 7 which have been stacked up are inserted into the box from the opened end through the gap between the base 40 and the tongue part 43 of the cardboard material.

Before the sheets 7 are inserted into the box, the direction of the sheets is preset so that the heat-sensitive surfaces (print surfaces) of the sheets will face toward the base 40, in order to let the heat-sensitive surfaces face the thermal head 15 when the sheet package 9 is set in the printer and the sheets 7 are fed to the print mechanism unit 14 of the printer.

Figure 11:
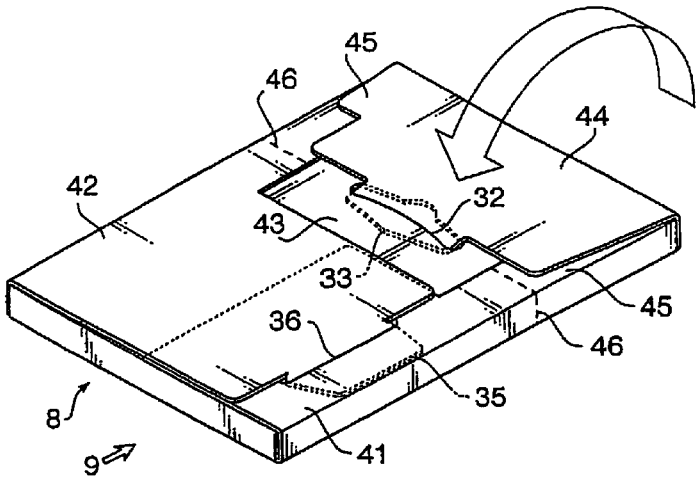
FIG. 11 is a perspective view showing a step for closing a flap part of the package member.

After the insertion of the sheets 7, the flap part 44 is folded upward and an insert 33 at the tip of the flap part 44 is inserted into the second cut 32 of the tongue part 43 as shown in FIG. 11, by which the opened end of the box is fixed in the state covered by the flap part 44.

By the above process, the sheet package 9 shown in FIG. 5 is completed. In this embodiment, the above process for manufacturing the sheet package 9 is carried out by the manufacturer. The user of the printer 1 purchases the sheet package 9 sold in the state of FIG. 5, processes the sheet package according to the following simple procedure, and then uses the package by setting it in the printer 1.

Next, the procedure for setting the sheet package 9 (originally in the state of FIG. 5) in the printer will be explained referring to FIGS. 12 through 16.

Figure 12:
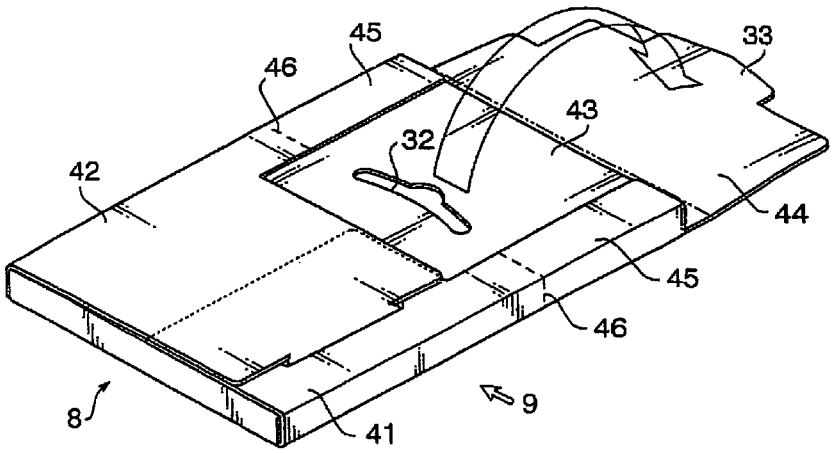
FIG. 12 is a perspective view showing a step for opening the flap part of the package member for using the sheet package for the printer.
Figure 13:
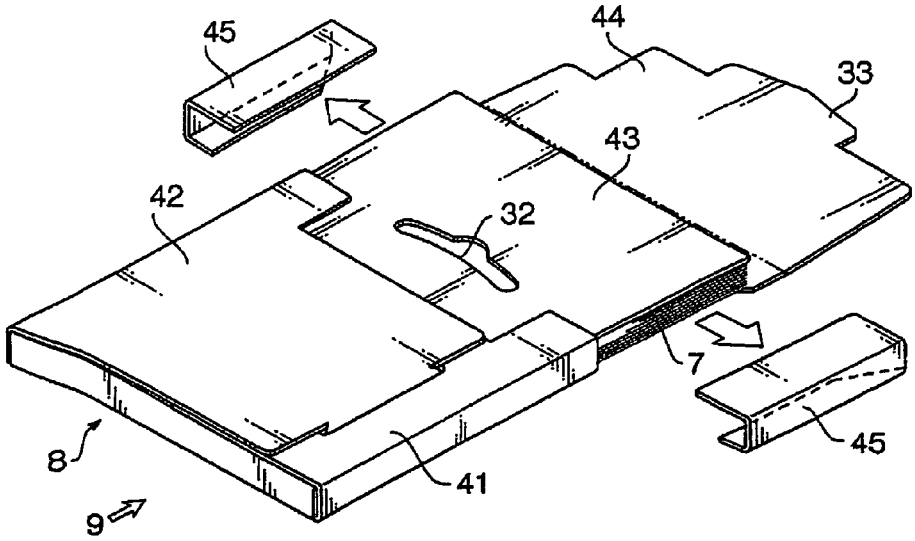
FIG. 13 is a perspective view showing a step for cutting off tear-off parts.

First, the user pulls out the insert 33 of the flap part 44 from the second cut 32 of the sheet package 9 in the state of FIG. 5 and thereby opens the flap part 44 as shown in FIG. 12.

Subsequently, the user pulls tear-off parts 45 of the first and second wrapping parts 41 and 42 by fingers to both sides and thereby cuts the tear-off parts 45 away. As shown in FIG. 6, each tear-off part 45 is formed across the boundary between the base 40 of the package member 8 and each wrapping part 41, 42. For facilitating the tear-off process perforations 46 are formed along the outline of each tear-off part 45.

Figure 14:
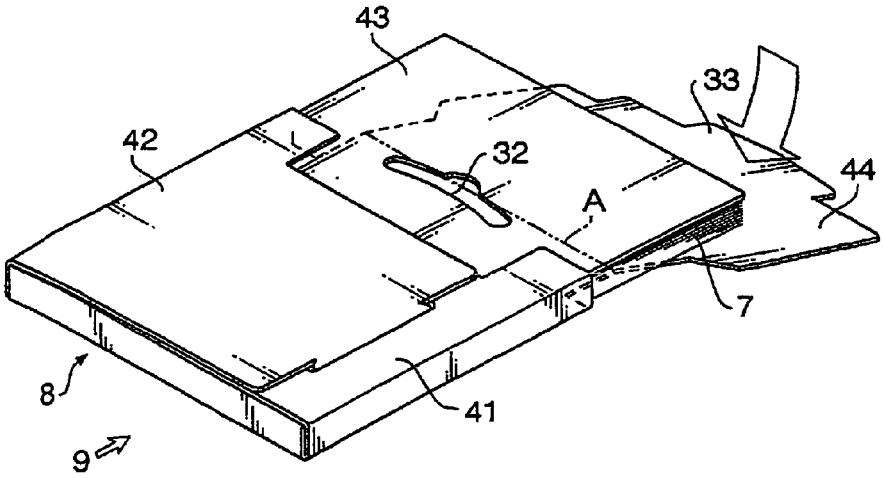
FIG. 14 is a perspective view showing a step for folding the flap part downward.

The above tear-off process (removal of the tear-off parts 45) enables the user to fold a distal part of the base 40 (from a crease A shown in FIG. 6) downward together with the flap part 44 as shown in FIG. 14.

Figure 15:
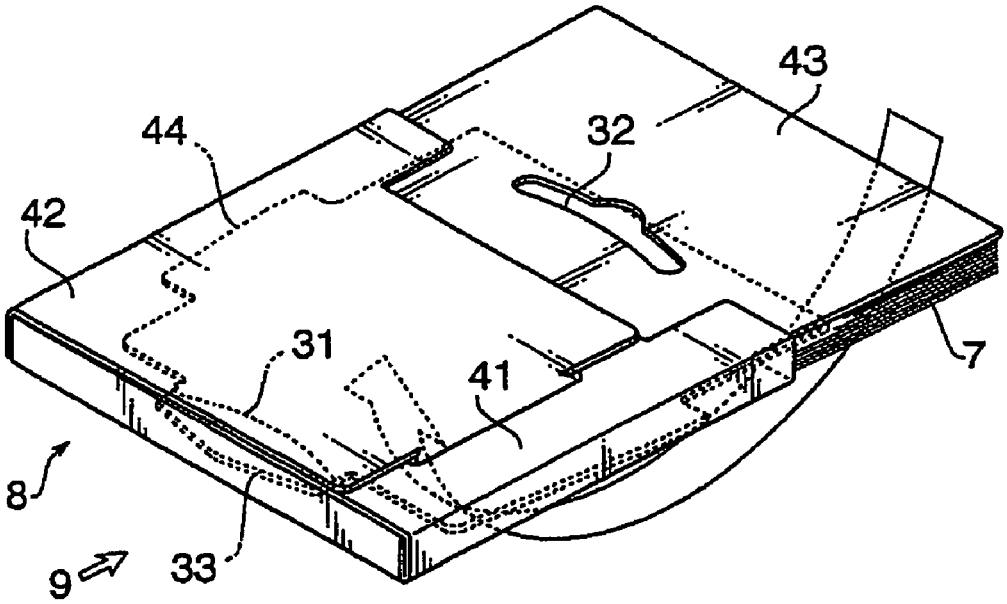
FIG. 15 is a perspective view showing a step for fixing the flap part on a base side.

With the flap part 44 and the base 40 folded as above (FIG. 14), the user puts the insert 33 at the tip of the flap part 44 into the first cut 31 (formed in the base 40 of the package member 8 as shown in FIG. 6) as shown in FIG. 15.

By the above process the flap part 44 is fixed in its opened state and thereby the sheets 7 inside the sheet package 9 are partially exposed from the, package member 8.

Incidentally, by the aforementioned configuration of the tear-off parts 45, the package member 8 is prevented from being folded at the crease A when the tear-off parts 45 have not been torn off (when the sheet package 9 has not been used), by which the sheets 7 in mint condition are prevented from being exposed from the package member 8 and protected securely.

Figure 16:
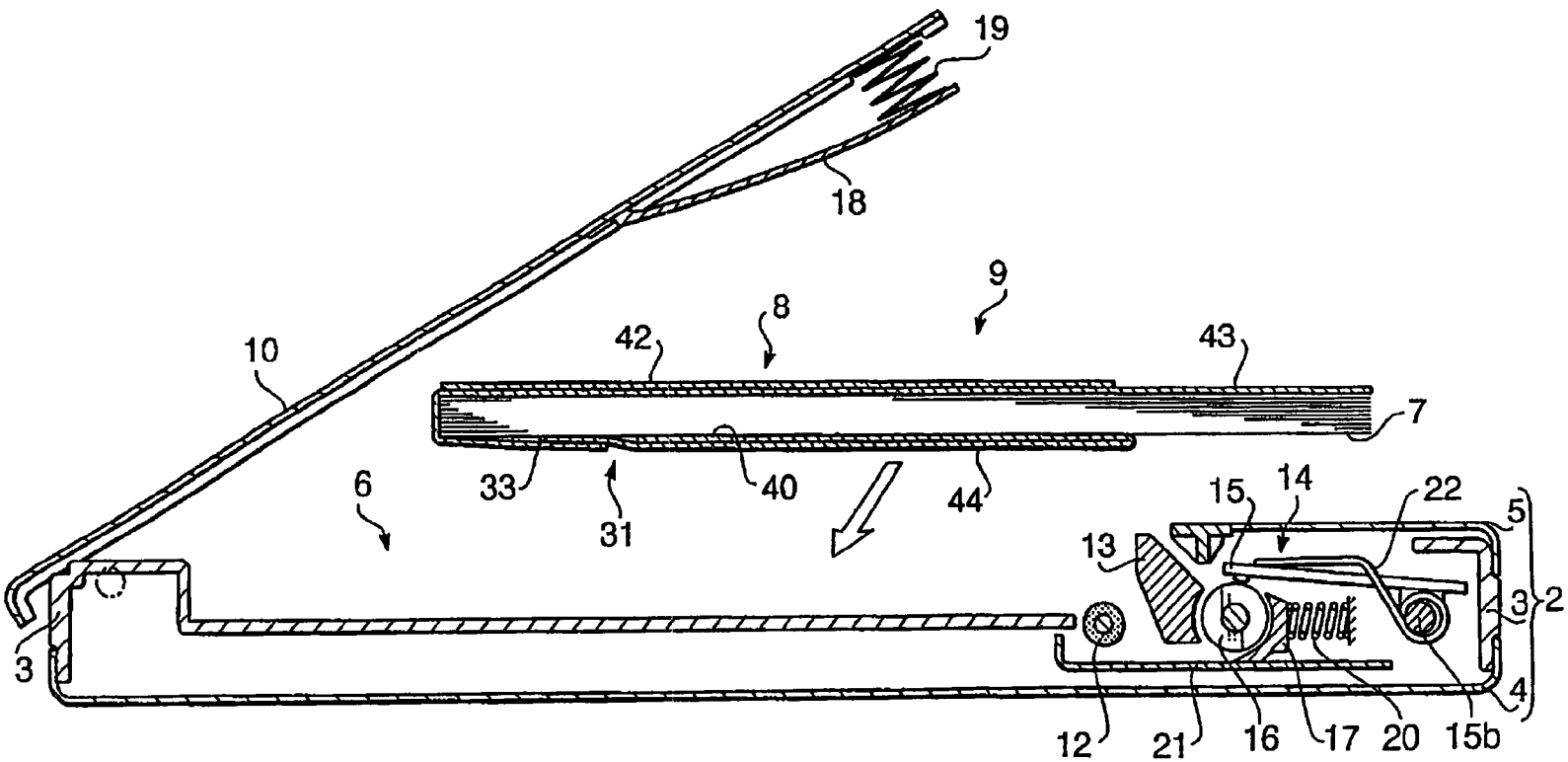
FIG. 16 is a sectional side view showing a step for setting the sheet package in the printer.

Subsequently, the sheet package 9 in the above state is set in the sheet storage unit 6 of the printer 1 as shown in FIG. 16, by which a part of the lowermost one of the sheets 7 (stacked up in the package member 8) exposed from the package member 8 makes contact with the top of the pickup roller 12. Thus, by driving and revolving the pickup roller 12 in this state, the sheet 7 can be extracted from the stack and fed.

Thereafter, the lid 10 of the printer 1 is closed as shown in FIGS. 3 and 4. In this state, the tongue part 43 of the package member 8 Is placed between the pressure plate 18 (pressing member) for pressing the sheets 7 against the pickup roller 12 and the sheets 7.

By the above procedure, the sheets 7 are set in the printer 1 in the form of the sheet package 9. After the sheets 7 are extracted from the stack one by one and thereafter used up, the remaining package member 8 is pulled out of the printer 1 and discarded.

The configuration described above is advantageous in that the sheet separation performance of the pickup roller 12 and the separation block 13 does not deteriorate even in the use of the printer 1 for many years. Assuming that the sheet package 9, is designed to let the sheets 7 directly contact the pressure plate 18 (not via the tongue part 43), the friction between the pressure plate 18 and the stack of sheets 7 eventually drops due to the wearing-out of the pressure plate 18 in the long-standing use of the printer 1, causing the deterioration of the sheet separation function and multi feeding (feeding two or more sheets 7 at once). Meanwhile, in this embodiment, the part that directly contacts the stack of sheets 7 is the tongue part 43, which is replaced with a new one together with the package member 8 each time when a prescribed number of sheets 7 are used up. Therefore, the friction between the tongue part 43 and the stack of sheets 7 does not drop even In the long-standing use of the printer 1, by which an excellent sheet separation function is maintained consistently and thereby sheet feed failure/trouble such as the multi feeding can be prevented from occurring.

Further, each of the first and second wrapping parts 41 and 42 for surrounding the tongue part 43 is formed in the shape of a letter "L" as shown in FIG. 6 so that the whole wrapping parts 41 and 42 will form a U-shape as shown in FIG. 15. By such configuration, the pressure plate 18, pressing the tongue part 43 without the interference of the wrapping parts 41 and 42, is allowed to securely press the sheets 7 against the pickup roller 12 via the tongue part 43, by which the separation and feeding of the sheets 7 are carried out smoothly.

Incidentally, the printer 1 is designed to be capable of printing not only on a simple heat-sensitive sheet but also on various types of sheets such as a duplicate sheet (made by bonding two sheets together so as to allow simultaneous printing on two sheets by the printer 1), a label sheet (made by forming an adhesive layer on the back of heat-sensitive paper and bonding it to a separator or releasing paper so that the heat-sensitive paper after being printed can be stripped from the separator and stuck on something), etc., as needed.

There are cases where the user hopes to replace the sheets 7 with those of a different type before using up all the sheets 7 in the sheet package 9. Since each package member 8 in this embodiment is configured to store sheets of only one type, the user hoping for the replacement with different sheets 7 has to replace the entire sheet package 9.

In such cases, the user opens the lid 10 of the printer 1 and pulls out the sheet package 9 from the sheet storage unit 6.

Figure 17:
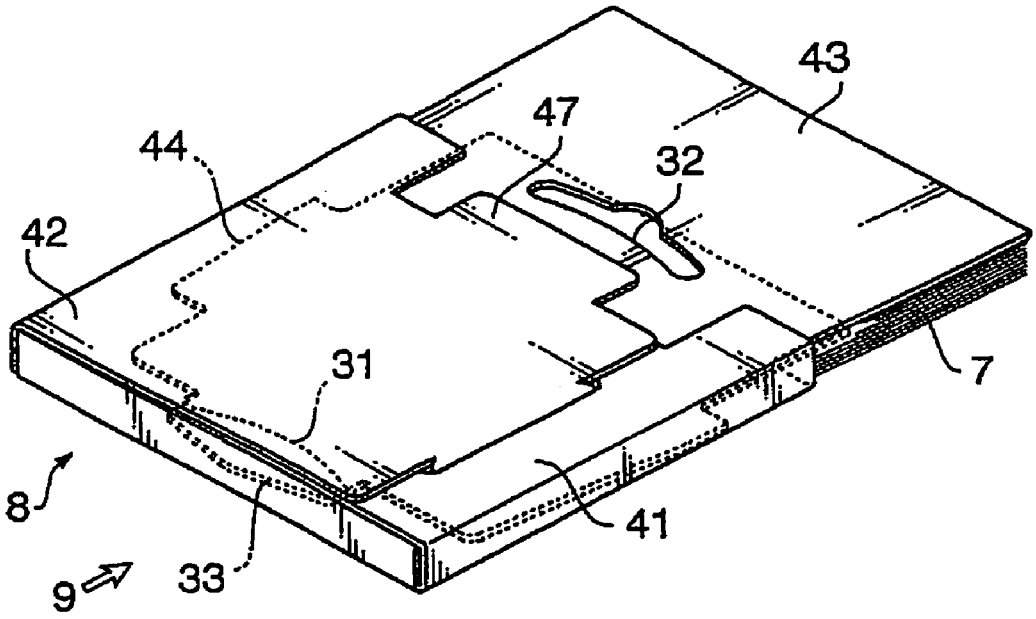
FIG. 17 is a perspective view showing a modification of the sheet package which is provided with a tab.

For facilitating the removal of the sheet package 9, the second wrapping part 42 of the package member 8 may be provided with a tab 47 as shown in a modification of FIG. 17. In this configuration, the sheet package 9 can be removed from the sheet storage unit 6 of the printer 1 easily by raising, holding and pulling the tab 47 by fingers.

Figure 18:
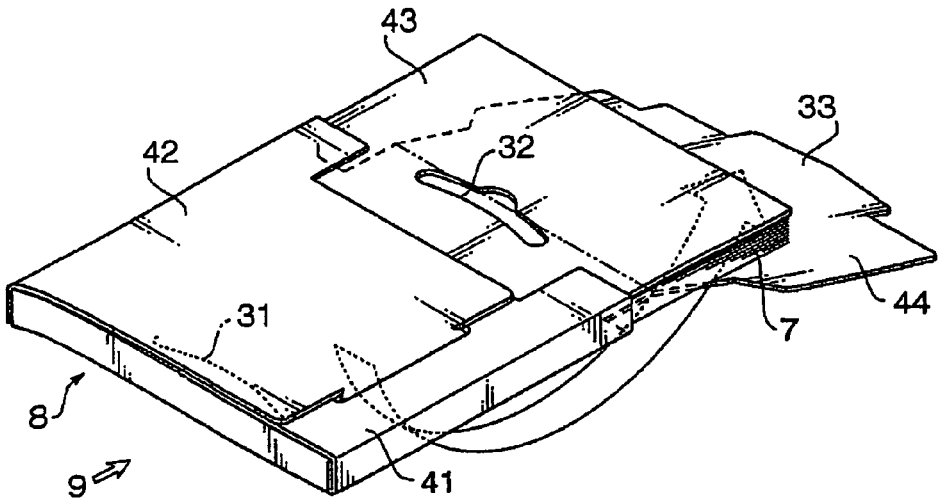
FIG. 18 is a perspective view showing a step for folding the flap part upward in the sheet package pulled out of the printer.
Figure 19:
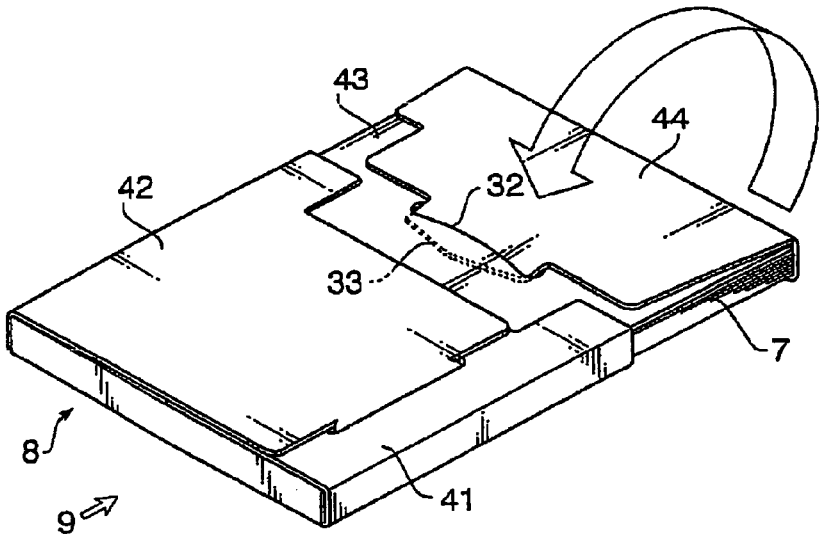
FIG. 19 is a perspective view showing a step for closing the flap part.

Thereafter, the insert 33 at the tip of the flap part 44 which has been folded underneath the base 40 is pulled out of the first cut 31, and the flap part 44 is folded upward as indicated by arrows in FIGS. 18 and 19. The insert 33 is then put into the second cut 32, by which the flap part 44 is fixed in a closed state (with the opened end of the package member 8 closed again) as shown in FIG. 19.

The sheets 7 are preserved in the state of FIG. 19. When the sheets 7 are used again, the insert 33 at the tip of the flap part 44 is pulled out of the second cut 32, the flap part 44 is folded downward, and the insert 33 is put into the first out 31 oppositely to the above process, by which the sheet package 9 is ready to be loaded in the printer 1.

As described above, the sheet package 9 of this embodiment is configured so that the flap part 44 can be fixed in the closed state even after the sheet package 9 is once set in a printer 1 and used and thereafter pulled out of the printer. Therefore, the sheets 7 inside are prevented from coming out of the package member 8 due to gravity, etc. and being scattered around, by which the sheets 7 can be handled easily and conveniently. Further, by almost totally wrapping and covering the heat-sensitive paper (sheets 7) which is generally susceptible to heat and light, deterioration of the heat-sensitive paper can be avoided and thereby excellent print quality is secured when the sheet package 9 after preservation is used again for the printer 1.

The flap part 44 is formed integrally with the package member 8 and is only folded (without being cut off) when the sheet package 9 is set in the printer 1. Therefore, the user is prevented from losing the flap part 44 and being unable to close the package member 8.

The flap part 44 is designed to allow the user to open and close the package member 8 by only changing the direction (upward/downward) of folding it, by which easy handling and improved usability of the package are realized.

Further, the state of the package member 8 partially exposing the sheets 7 can be maintained securely only by putting the insert 33 of the flap part 44 into the first cut 31.

Similarly, the state of the package member 8 covering the sheets 7 again can be maintained securely only by putting the insert 33 into the second cut 32. Since the second cut 32 is specially formed in the tongue part 43, the insertion of the insert 33 becomes easier compared to cases where the cut is made into the wrapping parts 41 and 42, etc., by which still easier handling of the sheet package 9 is realized.

Figure 20:
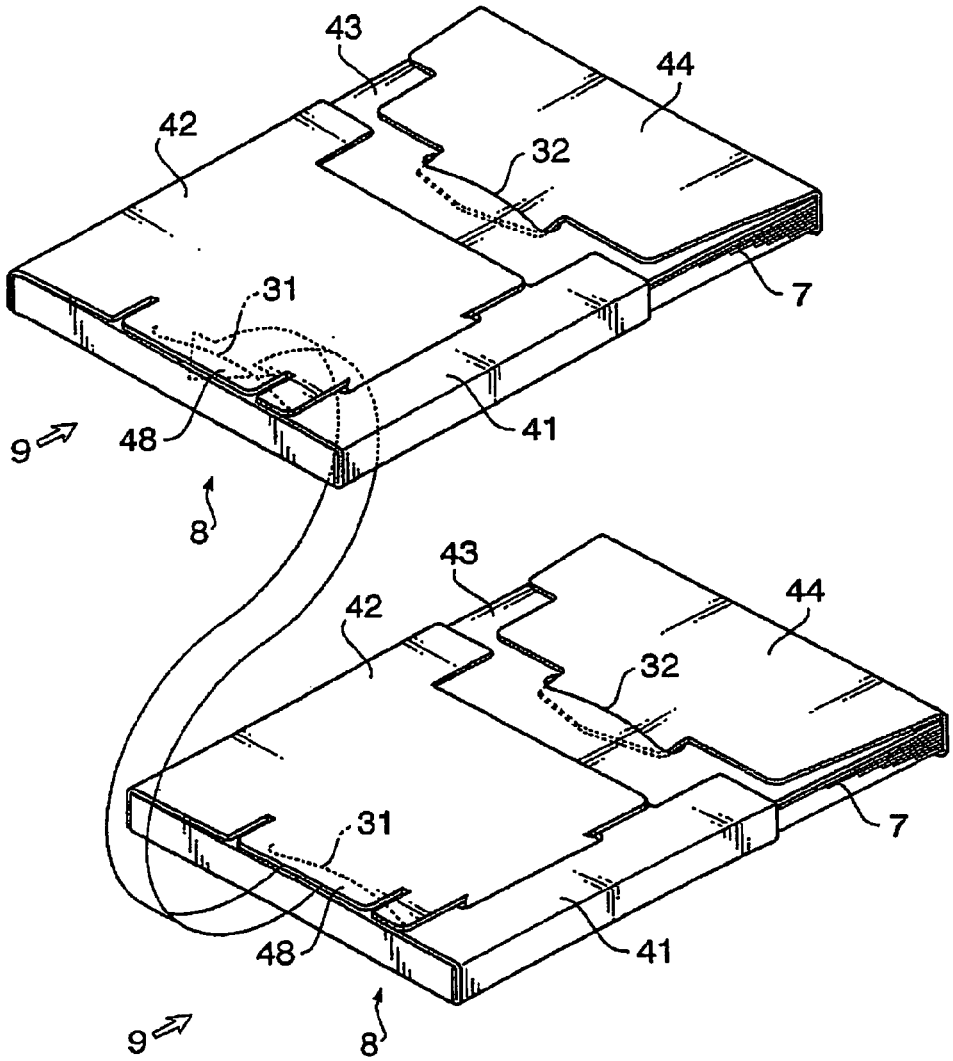
FIG. 20 is a perspective view showing a modification of the sheet package which enables connection of a plurality of sheet packages.

Referring to a modification of FIG. 20, it is also possible to provide the second wrapping part 42 with an insert 48 so that it can be inserted into the first cut 31 of another sheet package 9 as indicated by the arrow. By this configuration, a plurality of sheet packages 9 can be connected together as shown in FIG. 21, allowing the user to easily handle a lot of packages in a lump.

Figure 21:
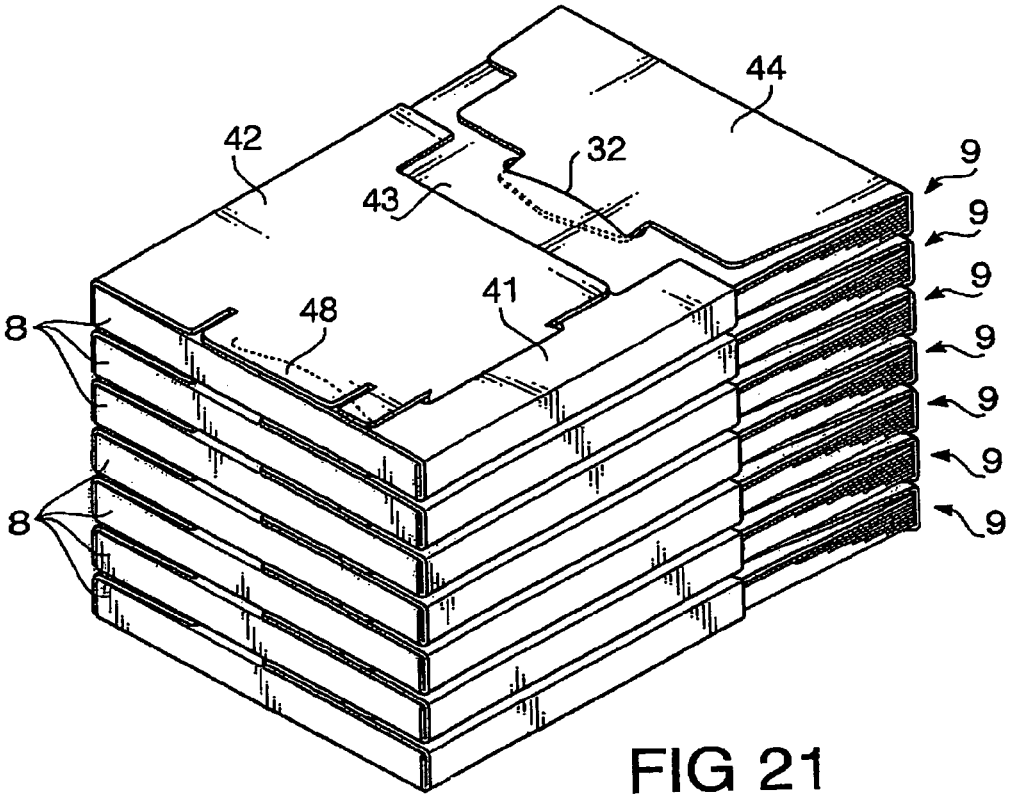
FIG. 21 is a perspective view showing a plurality of sheet packages connected together.

The length of the insert 48, the position of the first cut 31, etc. are set properly so that a plurality of sheet packages 9 can be aligned and connected together as shown in FIG. 21. This configuration is advantageous to the user in that a lot of sheet packages 9 can be grouped in a small size without the need of extra space for storage, etc.

Incidentally, the lid 10 of the printer 1 is provided with a window 49 which is made of transparent synthetic resin as shown in FIG. 1, by which the user can check the inside of the sheet storage unit 6 through the window 49 even when the lid 10 is closed.

Figure 22:
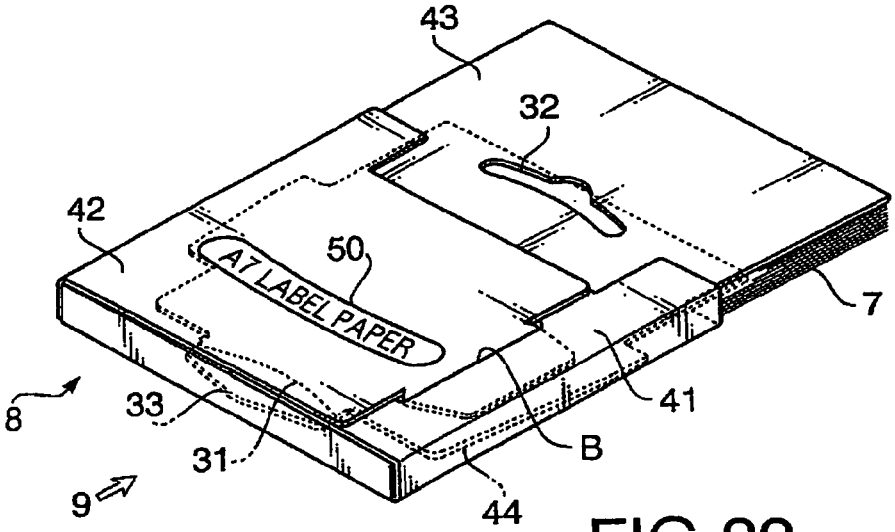
FIG. 22 is a perspective view showing a modification of the sheet package which is provided with an indicator part.

Corresponding to the window 49, the sheet package 9 may be provided with an indicator part 50 as shown in FIG. 22, in which the indicator part 50, indicating the type and size of the sheet 7, is provided to a part of the second wrapping part 42 corresponding to the window 49 by printing. By this configuration, the user is allowed to check the type and size of the sheets 7 currently set in the printer 1 without opening the lid 10, by looking into the window 49 and seeing the indicator part, 50 inside.

In the package member 8, the second wrapping part 42 is designed relatively longer than the first wrapping part 41 as shown in FIG. 6 and thereby a part B shown in FIG. 22 (where the second wrapping part 42 is joined to the first wrapping part 41) is placed in the vicinity of an end of the package member 8, so that the joining part B will not overlap with the aforementioned part of the second wrapping part 42 (where the indicator part 50 is formed) corresponding to the window 49.

By such configuration, the need of forming the indicator part 50 across the joining part B is eliminated, facilitating the formation of the indicator part 50 by printing etc. Further, misregistration in the printed indicator part 50 at the joining part B, making the indicator part 50 unrecognizable and toughening the checking of the type etc. of the sheet 7, can be avoided.

As set forth hereinabove, by the present invention configured as above, the flap part of the sheet package can be closed again even after the sheet package is set in the printer with the flap part opened and thereafter the sheet package is pulled out of the printer, by which the handling of the sheet packages is facilitated.

While the above embodiment has been presented as an illustration various modifications can be made to the embodiment regarding the sizes shapes, etc. of the flap part, the wrapping parts and the tongue part of the sheet package. The present invention is not to be restricted by the above particular illustrative embodiment but to be appreciated on the basis of the appended claims.

What is claimed is:

1. A sheet package comprising:

sheets as print mediums for a printer; and a package member surrounding a stack of the sheets, the sheet package being configured for use in a printer such that the sheets can be set in the printer together with the package member exposing part of the sheets, wherein the package member is integrally provided with a recloseable flap member that can be folded between an open and closed state, wherein the package member includes a first fastening member located on a first side of the package member to fasten the flap member in a closed state where the flap member covers a part of the sheets, wherein the flap member may be folded in an open state where the flap member exposes said part of the sheets, wherein the package member includes a second fastening member located on a second side of the package member, wherein when the flap member is in the open state with the flap member folded back down so as to be adjacent and parallel to the second side of the package member, the first side of the package member completely covers and extends completely along an edge at an end of the package member where the flap member is disposed, the edge defining a distal-most continuous boundary of the package member extending substantially a full width of the package member, and wherein the package member includes two or more removable tear-off members that, when attached to the package member, permit the flap member to be in the open state but prevent the flap member from being folded back down so as to be adjacent and parallel to the second side of the package member and fastened to the second side of the package member via the second fastening member, the flap member being permitted to be folded back down so as to be adjacent and parallel to the second side of the package member and fastened to the second side of the package member via the second fastening member when the two or more tear-off members are removed from the package member.

2. The sheet package according to claim 1, wherein the flap member is formed in a portion of the package member, wherein the flap member can be set in a state exposing part of the sheets by folding the portion of the package member to the second side of the package member, and wherein the flap member can be set in a state covering the exposed part of sheets by folding the portion of the package member to the first side of the package member.

3. The sheet package according to claim 2, wherein the package member is configured such that the portion is rendered foldable when a prescribed part of the package member is removed from the package member.

4. The sheet package according to claim 2, wherein the package member is provided with a tongue part which is exposed when the portion of the package member is folded to the second side of the package member, and wherein the tongue part is configured such that the tongue part is placed between (a) a pressing member for pressing the exposed part of the sheets against a roller of the printer and (b) the sheets, when the sheet package is set in the printer.

5. The sheet package according to claim 4, wherein the package member is provided with a first cut as the second fastening member with which the portion of the package member folded to the second side of the package member can be engaged to fix the flap member in the open state.

6. The sheet package according to claim 5, wherein the package member is provided with a second cut as the first fastening member with which the portion of the package member folded to the first side of the package member can be engaged to fix the flap member in the closed state.

7. The sheet package according to claim 6, wherein the second cut is provided to the tongue part.

8. The sheet package according to claim 5, wherein the package member is configured such that a plurality of sheet packages can be connected together in an aligned state by inserting a part of the package member of one sheet package into the first cut of another sheet package.

9. The sheet package according to claim 4, wherein the package member includes a wrapping part which surrounds at least a part of an outside of the tongue part, the wrapping part being provided with a tab such that the sheet package set in the printer can be removed from the printer by holding and pulling the tab.

10. The sheet package according to claim 1, wherein the sheets include heat-sensitive sheets.

11. A sheet package, comprising:

sheets suitable as print mediums for a printer; and a package member surrounding a stack of the sheets, the sheet package being configured such that the sheets can be set in the printer together with the package member exposing part of the sheets, wherein the package member includes a base having a rectangular shape and substantially the same size as the sheet, around which a flap part, a tongue part opposed to the flap part, a first wrapping part, and a second wrapping part opposed to the first wrapping part are formed, and wherein the package member also includes a fastening member to fasten the flap part in a closed state covering the sheets, wherein the package member is configured such that the package member can be fixed in a box shape by folding the flap part, the first wrapping part, the second wrapping part and the tongue part with respect to the base, wherein the flap part is configured such that the flap part can be turned from the closed state covering the sheets to an opened state exposing part of the sheets by folding the flap part to a side of the package member that includes the base, wherein the sheet package is configured such that the sheet package can be set in the printer with the flap part fixed in the opened state exposing the part of the sheets while the exposed part of the sheets can be covered with the flap part fixed in the closed state when the sheet package is not being used in the printer, wherein when the flap part is in the open state with the flap part folded back down so as to be adjacent and parallel to the side of the package member that includes the base, an opposite side of the package member completely covers and extends completely along an edge at an end of the package member where the flap part is disposed, the edge defining a distal-most continuous boundary of the package member extending substantially a full width of the package member, and wherein the package member includes two or more removable tear-off members that, when attached to the package member, permit the flap member to be in the open state but prevent the flap member from being folded back down so as to be adjacent and parallel to the second side of the package member and fastened to the second side of the package member via the second fastening member the flap member being permitted to be folded back down so as to be adjacent and parallel to the second side of the package member and fastened to the second side of the package member via the second fastening member when the two or more tear-off members are removed from the package member.

12. The sheet package according to claim 11, wherein the sheets include heat-sensitive sheets.

13. The sheet package according to claim 11, wherein the base is provided with a cut into which the flap part is inserted to fix the sheet package in the opened state.

14. The sheet package according to claim 11, wherein the tongue part is provided with a cut into which the flap part is inserted to fix the sheet package in the closed state.

15. The sheet package according to claim 11, wherein a crease is formed in the base for folding the flap part to the side of the package member that includes the base, and wherein the part of the sheets is exposed on the base side of the package member when the flap part is set in the opened state by folding the flap part to the side of the package member that includes the base from the crease formed in the base.

16. The sheet package according to claim 15, wherein the tongue part covers a surface of the sheets opposite the base when the flap part is set in the opened state by folding the flap part to the side of the package member that includes the base.

17. A sheet package, comprising:

sheets as print mediums for a printer; and a package member surrounding a stack of the sheets, said package member having an indicator part indicating information on the sheets, and a recloseable flap member that can be folded between an open and closed state, wherein the package member includes a first fastening member located on a first side of the package member to fasten the flap member in the closed state where the flap member covers a part of the sheets, and wherein the flap member may be folded in the open state where the flap member exposes said part of the sheets, wherein the sheet package is configured such that the sheets can be set in the printer together with the package member exposing part of the sheets and the indicator part can be seen through a window of the printer when the sheet package is set in the printer, and wherein the package member is formed by folding a plane material which is designed such that a joining part of the material is not placed at a position corresponding to the window of the printer when the sheet package is set in the printer, wherein the package member includes a second fastening member located on a second side of the package member, wherein when the flap member is in the open state with the flap member folded back down so as to be adjacent and parallel to the second side of the package member, the first side of the package member completely covers and extends completely along an edge at an end of the package member where the flap member is disposed, the edge defining a distal-most continuous boundary of the package member extending substantially a full width of the package member, and wherein the package member includes two or more removable tear-off members that, when attached to the package member, permit the flap member to be in the open state but prevent the flap member from being folded back down so as to be adjacent and parallel to the second side of the package member, and fastened to the second side of the package member via the second fastening member the flap member being permitted to be folded back down so as to be adjacent and parallel to the second side of the package member and fastened to the second side of the package member via the second fastening member when the two or more tear-off members are removed from the package member.

* * * * *